US008091698B2

(12) United States Patent
Joerger

(10) Patent No.: US 8,091,698 B2
(45) Date of Patent: Jan. 10, 2012

(54) TRANSPORT DEVICE FOR A FINGER JOINTING SYSTEM

(75) Inventor: Michael Joerger, Sasbachwalden (DE)

(73) Assignee: joema GmbH, Sasbachwalden (DE)

( * ) Notice: Subject to any disclaimer, the term of this patent is extended or adjusted under 35 U.S.C. 154(b) by 0 days.

(21) Appl. No.: 12/932,008

(22) Filed: Feb. 16, 2011

(65) Prior Publication Data

US 2011/0139306 A1 Jun. 16, 2011

Related U.S. Application Data

(63) Continuation of application No. 12/451,285, filed as application No. PCT/DE2008/000198 on Feb. 4, 2008.

(30) Foreign Application Priority Data

May 15, 2007 (DE) ..... 10 2007 022 988

(51) Int. Cl.
*B27F 1/16* (2006.01)

(52) U.S. Cl. ..... 198/416; 198/721; 144/2.1; 144/250.15

(58) Field of Classification Search ..... 198/416, 198/718, 721, 725; 144/2.1, 9.1, 242.1, 248.2, 144/250.14, 250.15
See application file for complete search history.

(56) References Cited

U.S. PATENT DOCUMENTS

| | | | | |
|---|---|---|---|---|
| 3,927,705 | A | 12/1975 | Cromeens et al. | |
| 5,090,462 | A | 2/1992 | Dimter | |
| 5,431,272 | A | 7/1995 | Lindstrom | |
| 5,617,910 | A * | 4/1997 | Hill | 144/356 |
| 6,082,421 | A | 7/2000 | Nicol et al. | |
| 6,189,682 | B1 | 2/2001 | Hill | |
| 6,701,984 | B2 | 3/2004 | Lamontagne et al. | |

FOREIGN PATENT DOCUMENTS

| | | |
|---|---|---|
| DE | 39 41 976 | 7/1991 |
| DE | 43 12 169 | 5/1994 |
| DE | 94 15 333 | 7/1995 |
| EP | 0437245 | 7/1991 |
| EP | 0 505 392 | 9/1992 |
| WO | WO 9108876 | 6/1991 |

OTHER PUBLICATIONS

International Search Report for International Application PCT/DE2008/000198 dated Sep. 4, 2008.

DPMA Office Action in German Application No. DE 10 2007 022 988.9 dated Nov. 30, 2007 (w/English translation).

DPMA Office Action in German Application No. DE 10 2007 022 988.9 dated Sep. 20, 2010 (w/English translation).

* cited by examiner

*Primary Examiner* — Mark A Deuble

(74) *Attorney, Agent, or Firm* — Collard & Roe, P.C.

(57) ABSTRACT

A transport device for a system for finger jointing pieces of wood, by packets, has a support. Transport means are provided, which are set up for moving the pieces of wood sliding along the support to the system for finger jointing. The transport means have a gripping device for holding the pieces of wood in place by packets, aligned flush at a first end, which is situated upstream, while the pieces are being pulled to a work station by way of the support.

7 Claims, 13 Drawing Sheets

TRANSPORT DEVICE FOR A FINGER JOINTING SYSTEM

CROSS REFERENCE TO RELATED APPLICATIONS

This application is a continuation and claims priority under 35 U.S.C. §120 of U.S. patent application Ser. No. 12/451,285 filed Nov. 4, 2009, which application is a national stage application under 35 U.S.C. §371 of PCT Application No. PCT/DE/2008/000198 filed Feb. 4, 2008, which claims priority under 35 U.S.C. §119 of German Application No. 10 2007 022 988.9 filed on May 15, 2007. The international application under PCT article 21(2) was not published in English. The disclosures of each of the foregoing applications are hereby incorporated by reference.

BACKGROUND OF THE INVENTION

1. Field of the Invention

The present invention relates to a transport device for a system for finger jointing pieces of wood, having a support.

2. Prior Art

Such devices are usual for longitudinal gluing of rod-shaped pieces of wood, in other words for slats, boards, floorboards, and beams. In order to permanently connect the pieces of wood, the technique of finger jointing is used. For this purpose, the pieces of wood are sawed in corresponding finger jointing systems, at their ends, they are milled, then glued, and finally pressed together. These work steps can take place either in a single machine, or they can be functionally divided up among individual machines, depending on the system.

Two types of finger jointing systems are commonly in use: In individual processing, processing of the end face takes place with one piece of wood at a time. In packet-type processing, several pieces of wood are worked on at the same time, in order to increase the output, minimize splintering of the pieces of wood, and achieve precise glue application. In this connection, the pressing process always takes place in a separate press.

Among the packet systems, in turn, a differentiation is made between two different embodiments. In the case of a central packet system, only one central processing station is present for simultaneous or serial processing of two packets of wood, in each instance, on both sides of the machine. This is a tried and proven technique that has been in use for many years. However, the running meter output no longer meets today's requirements. For this reason, this type of system has been almost completely displaced by a second system type, in which a separate processing station is present per packet end, in each instance. In this connection, it is disadvantageous that because of the additional station, both a greater likelihood of breakdown and an additional space requirement occur.

In the case of all the system types mentioned, the transport of the pieces of wood in the longitudinal direction is carried out with conveyor belts or roller conveyors. Acceleration of the pieces of wood during transport takes place by way of adhesion friction between conveyor rollers, conveyor belt, and pieces of wood. The greatest possible acceleration values of the wood pieces are therefore limited by the low adhesion friction between them and the conveyor belt, thereby reducing the work speed of the system as a whole.

In the case of the conventional systems, alignment of the pieces of wood with regard to the packet end takes place in that the pieces of wood are conveyed lengthwise against a shaker stop. In this connection, the shaker stop pulsates in the transport direction, by about 1-5 cm, and thereby supports aligning of the pieces of wood.

In order to achieve uniform wood quality, the regions of the pieces of wood that have defects or irregularities such as knotholes are shortened by means of sawing. The lengths of wood within a wood packet can therefore demonstrate great differences, whereby the longest piece of wood can have a length up to ten times greater than that of the shortest piece of wood. The shorter pieces of wood must therefore move along the long pieces of wood during alignment, within the packet as a whole. It is a disadvantage, in this connection, that the friction between the pieces of wood hinders this relative movement.

While the longer pieces of wood are already at the shaker stop, and continue to be transported against the shaker stop when there are continuous rollers, the short pieces of wood are migrating in the direction of the stop. In this connection, the positions of the long pieces of wood, crosswise to the transport direction on the stop side, can change, and they therefore stand at a slant. Once the long pieces of wood have positioned themselves at a slant, additional forces that reinforce slanted positioning occur. As a result, and because of the adhesion friction between face ends of the pieces of wood and shaker plate, it is difficult or actually impossible to reposition them. Possible inaccuracies in the geometry of shaker plate and roller conveyor reinforce the tendency toward slanted positioning, in this connection.

Because of the slanted positioning, the pass-through path of the short pieces of wood between the long pieces of wood, or between the long pieces of wood and the side wall, is made narrower, so that the short pieces of wood do not pass through all the way to the end stop, and get stuck on the way.

It is true that some systems have an electronic system for recognizing when short pieces of wood have gotten stuck, and for eliminating the jam-up by means of various mechanical cycle movements. However, the electronics are complicated, on the one hand, and have a tendency to break down, on the other hand. Furthermore, not all problems are recognized. Even if it is possible to do so, manual intervention is generally required, and correcting these problems involves a time delay in the work sequence.

SUMMARY OF THE INVENTION

The present invention is therefore based on the task of proposing a system that demonstrates improved operational reliability as compared with the state of the art, and furthermore allows a greater work speed.

The task on which the invention is based is accomplished by means of a device having the characteristics disclosed herein.

According to the invention, transport means are provided for the transport device, which are set up for moving the pieces of wood by way of a support.

It is advantageous that the pieces of wood can be accelerated or braked more strongly by means of pulling or pushing than by means of a moving support such as a conveyor belt or rollers, for example, thereby improving the work speed of the transport cycle. Furthermore, slanted positioning of the packets of wood is made more difficult, and this significantly improves the operational reliability of the system.

In a preferred embodiment, a gripping device is provided for the transport means.

It is advantageous that a particularly great force can be exerted on the pieces of wood by means of the gripping device. These are therefore fixed in place, in their position relative to one another, in particularly firm and secure manner.

Furthermore, the position relative to the gripper is also fixed in place in particularly secure manner.

In a preferred embodiment, the gripping device is set up for grasping and clamping pieces of wood on their longitudinal sides and at their top, by means of a clamping device, at their end that is situated upstream.

It is advantageous that a pressure that presses the pieces of wood together, with force fit, is exerted on the packet end, from two longitudinal sides of a packet of wood that contains multiple pieces of wood, by means of a clamping device. Since the pieces of wood are grasped at the packet end that is situated upstream, in other words in the transport direction, the packet of wood is pulled by the gripping device, not pushed. In this way, the operational reliability is further improved, since the individual pieces of wood cannot wedge into one another.

In yet another preferred embodiment, the gripping device has at least one clamping device having a clamping cylinder.

It is advantageous that the force for grasping and holding the packet of wood is produced in this way. High pressures can be achieved, which can be easily adjusted and adapted to the width and height of the packet of wood.

In yet another preferred embodiment, a pusher is provided for the transport means, which pusher is set up to push the pieces of wood upstream.

It is advantageous that the movement of the gripping device in the transport direction can be utilized in this way, in order to convey another packet of wood. It is furthermore advantageous that the different pieces of wood of the packet of wood are aligned with their faces flush, by means of the pushing process.

In a further development of the preferred embodiment, the pusher can be raised or lowered by means of a lifting device.

It is advantageous that the pusher is lowered for pushing and aligning, so that its contact surface lies against the face sides of the pieces of wood. When the pusher is moved back into its starting position, counter to the transport direction, then it is raised so that it does not come into contact with the subsequent piece of wood or packet of wood, and disrupt its transport.

In yet another further development, the support is configured as a trough having side walls, in such a manner that the distance of the walls relative to one another is adjustable.

It is advantageous that the pieces of wood can glide along on the support surface of the trough, without transport rollers or anything similar being required. A packet of wood is guided by the side walls during transport. Since the distance of the side walls from one another is adjustable, the support can be adapted to different widths of the packets of wood.

In yet another further development of the preferred embodiment, the support has transport elements, particularly driven roller conveyors, which act counter to the transport direction.

It is advantageous that the flush face alignment of the pieces of wood is supported by this.

In a preferred embodiment, the transport means are set up to move the pieces of wood over the support in packets.

It is advantageous that a particularly high processing speed can be achieved.

Furthermore, the present invention relates to transport means for a system for finger jointing pieces of wood, having a support, whereby the transport means are set up to move the pieces of wood over the support.

Furthermore, the present invention relates to a method for transport of pieces of wood in a system for finger jointing, whereby the pieces of wood are moved over a support by transport means.

In a preferred embodiment, the pieces of wood are moved in packets.

BRIEF DESCRIPTION OF THE DRAWINGS

In the following, the invention will be described in greater detail, making reference to the drawings. These show.

DETAILED DESCRIPTION OF THE INVENTION

In order to give an impression of the function of the system according to the invention, a complete cycle of the system 1, with the work steps described below, will be shown using FIG. 1 to FIG. 7.

Figure 1:
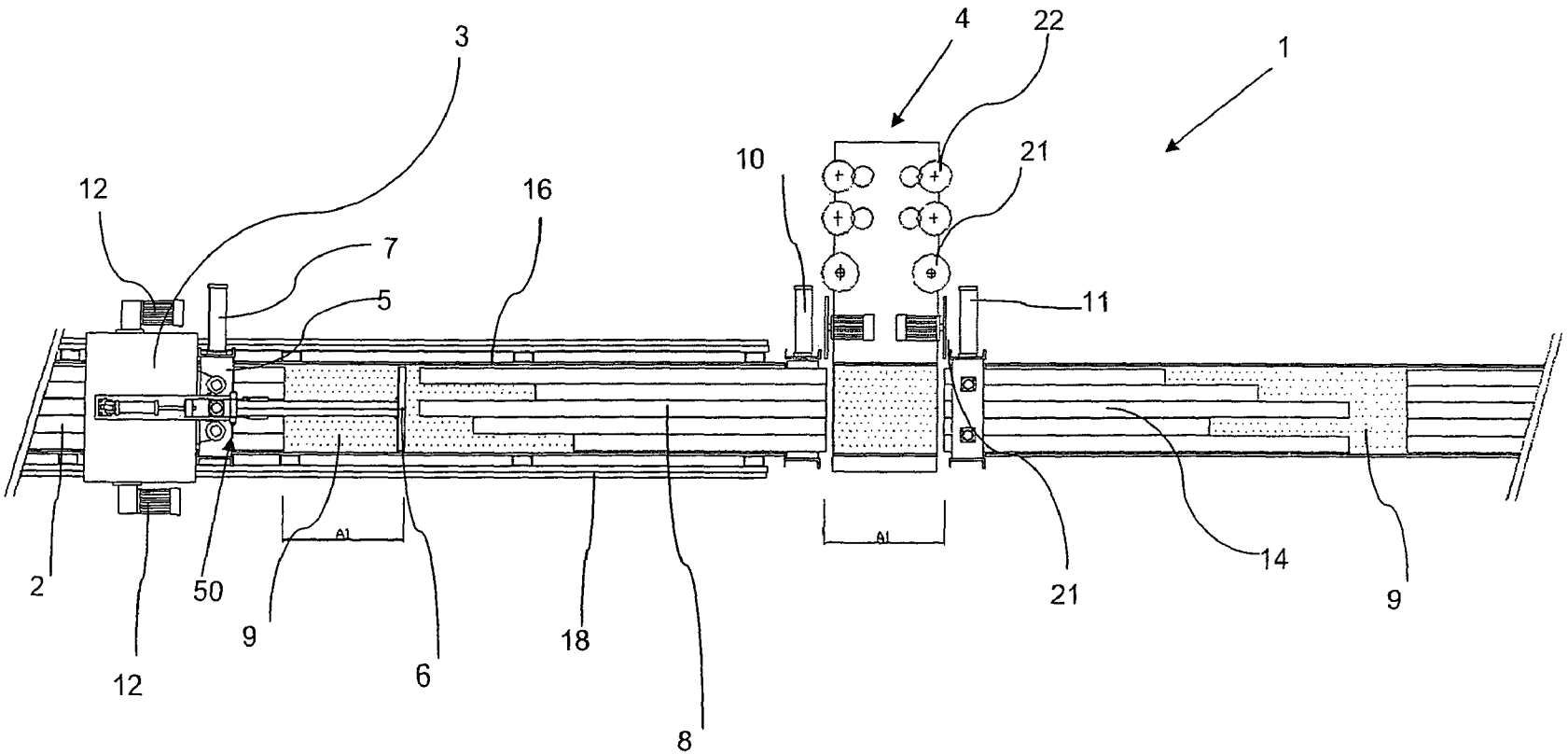
FIG. 1 a top view of the transport device according to the invention, for a system for finger jointing pieces of wood.

FIG. 1 shows a top view of a transport device according to the invention, for a system for finger jointing pieces of wood. The transport means 3 according to the invention are shown. These have a gripping device 50 having a clamping device 5 and a pneumatic clamping cylinder 7. A packet of wood having multiple pieces 2 of wood is clamped in by means of the clamping device 5, in that the clamping cylinder 7 exerts pressure on both longitudinal sides of the packet of wood having multiple pieces 2 of wood, by way of two contact surfaces 15 that lie opposite one another (not shown, see FIG. 12), and thus holds the packet of wood having multiple pieces 2 of wood firmly relative to the gripping device 50. The pieces 2 of wood of the packet of wood are thereby fixed in place, in their position relative to one another, in firm and secure manner. Reciprocal displacement or slanted positioning of pieces 2 of wood that have already been aligned with one another is therefore not possible during transport, and this significantly improves the operational reliability of the system 1. In this way, the packet of wood having multiple pieces 2 of wood can be accelerated and braked more strongly, thereby improving the work speed of the transport cycle. By means of the pneumatic clamping cylinder 7, high pressures can be achieved, which are easily adjustable and can be adapted to the width of the packet of wood.

Below the transport means 3, there is a trough 9. The trough 9 serves to accommodate and guide the packets of wood that slide along in it, with its side walls 16. By means of adjusting the distance between the side walls 16, relative to one another, the accommodation can be adapted to different widths of the packets of wood having multiple pieces 2 of wood.

The transport means 3 are movable and can perform a linear translation movement along the trough 9. Two electric motors 12 are provided as a drive; they are situated on two sides of the transport means 3. The electric motors 12 engage into racks 18 that run parallel to the sides 16 of the trough 9, by means of a gear wheel 17 (not shown), in each instance, and thereby produce the forward drive. During the movement, the packet of wood having multiple pieces 2 of wood is pulled to slide along the trough 9. By means of this pulling, the operational reliability is further improved, since the individual pieces 2 of wood cannot wedge into one another.

Furthermore, a pusher 6 is provided on the transport means 3, which pushes another packet of wood having multiple pieces 8 of wood upstream, at the same time, with the movement of the transport means 3. In this connection, the different pieces 8 of wood are furthermore aligned with their faces flush, by means of the movement.

The transport means 3 transport the packets of wood having multiple pieces 2, 8 of wood to a central work station 4, which has saws 20, milling devices 21, and glue rollers 22. In this way, it is possible to saw, mill, and glue the ends of two packets of wood in one work step. Nevertheless, a higher running meter output is achieved than in the case of separate stations. In the region of the trough 9, another clamping device 10, 11 is provided before and after the work station 4, in each instance. When the end of a packet that has been aligned flush reaches the work station 4, then it is clamped again and held in place by the front clamping device 10. Likewise, an end of another packet of wood having multiple pieces 14 of wood is clamped and held in place by the rear clamping device 11. During simultaneous processing, the two packets of wood having multiple pieces 8, 14 of wood are securely fixed in place. During the processing steps, in other words sawing, milling, and gluing, the work station 4 moves up and down perpendicular to the direction of movement of the gripping device 50.

Behind the work station 4, the trough 9 extends further, so that the processed packets of pieces of wood can be transported further and pressed (press not shown).

The entire work steps described, in other words including gripping the pieces 2, 8, 14 of wood, moving the transport means 3 in the direction of the work station 4, retracting the transport means 3, sawing, milling, and gluing of the pieces 2, 8, 14 of wood by means of the work station 4, etc., are coordinated by means of a central control (not shown), and harmonized with one another. However, the control is not shown here and not described, because the necessary adaptation of the control is obvious to a person skilled in the art.

Figure 2:
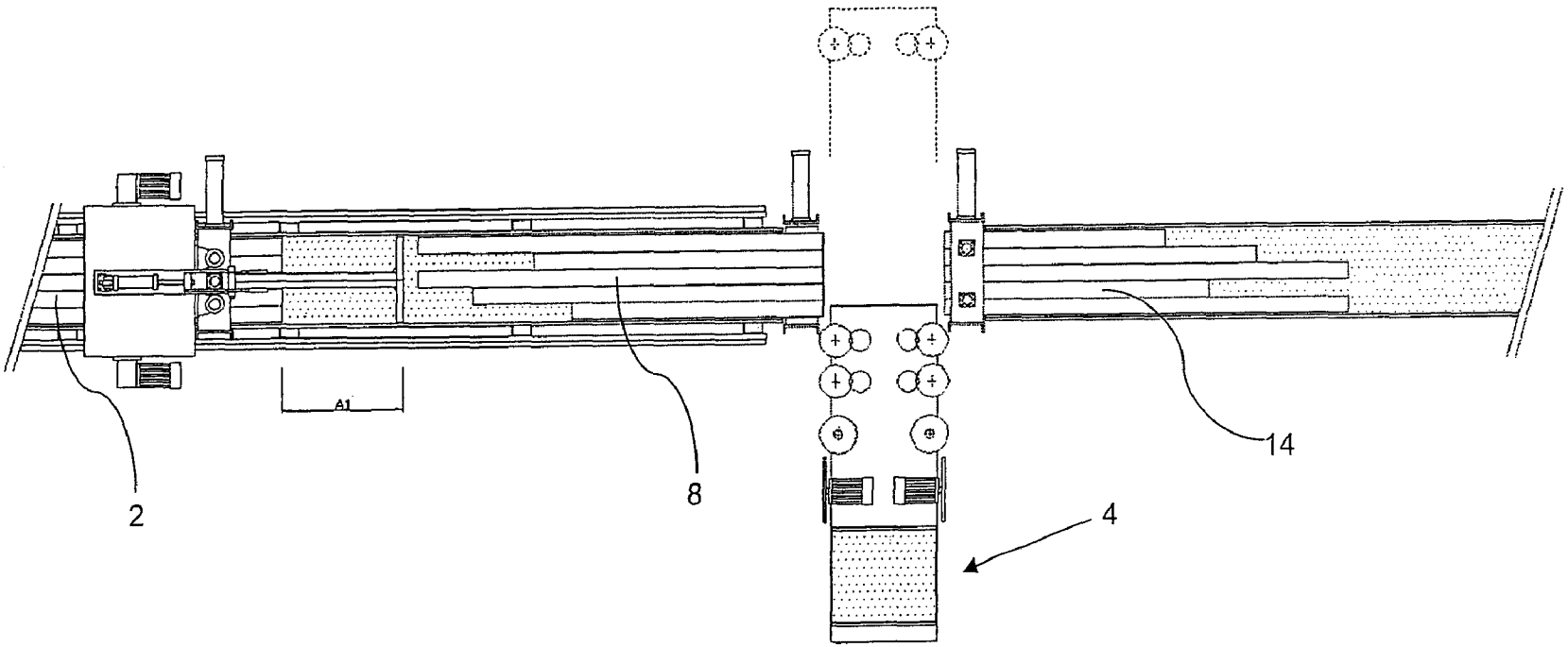
FIG. 2 a top view of the device from FIG. 1, after processing of the pieces of wood.

FIG. 2 shows a top view of the device from FIG. 1, after processing of the pieces of wood. The work station 4 has moved to an opposite position.

Figure 3:
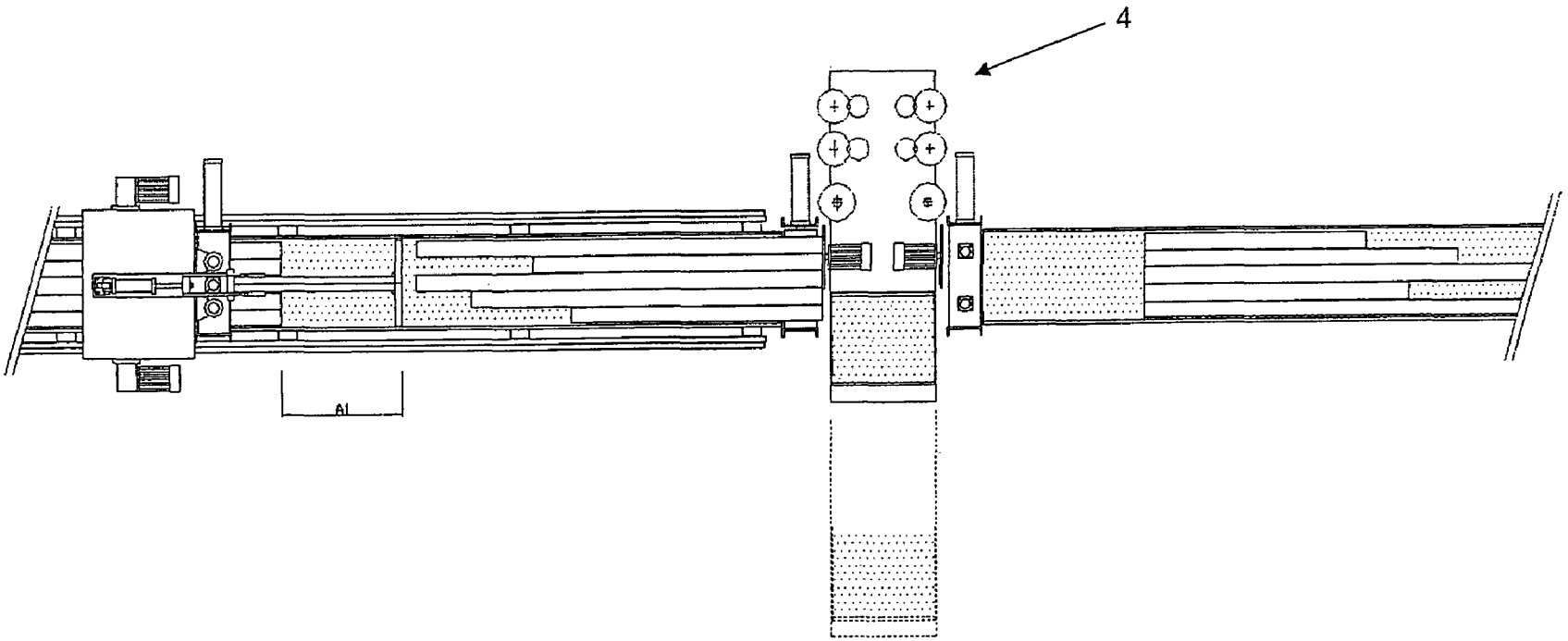
FIG. 3 a top view of the device from FIG. 1, during retraction of the processing station.

FIG. 3 shows a top view of the device from FIG. 1, during retraction of the processing station.

Figure 4:
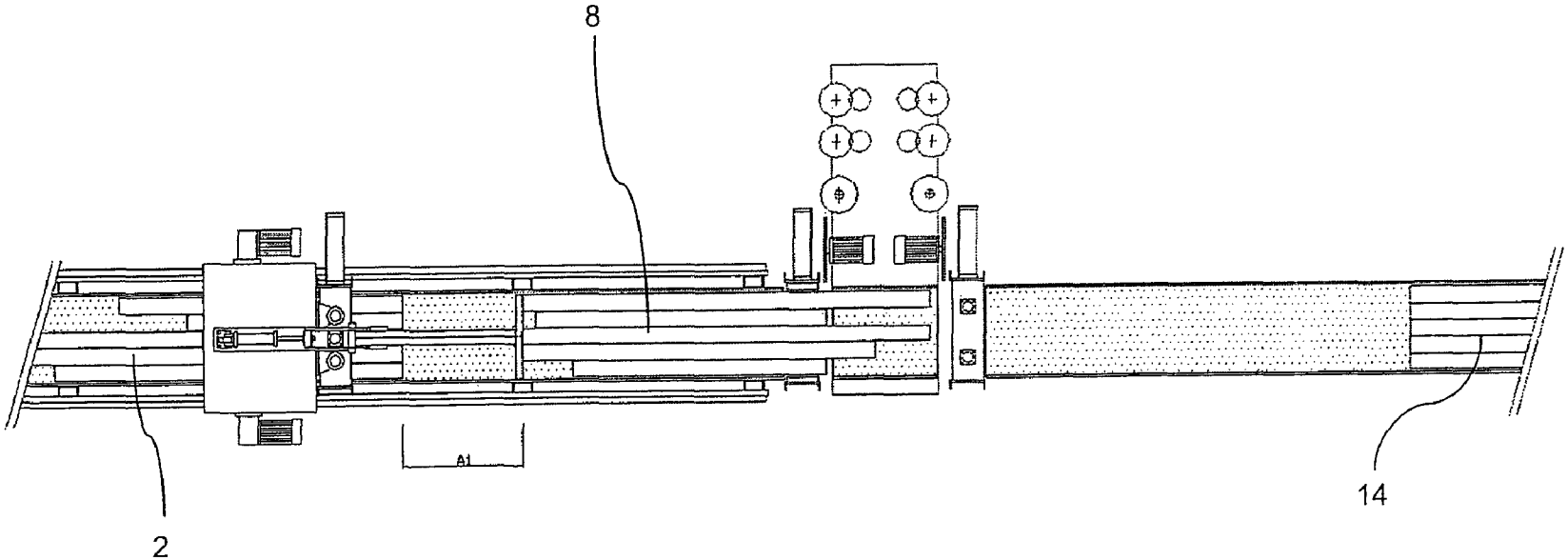
FIG. 4 a top view of the device from FIG. 1, after transport of a packet of wood through the processing station.

FIG. 4 shows a top view of the device from FIG. 1, after transport of a packet of wood through the processing station. The processing station 4 has already reached its original position as in FIG. 1 once again. The processed packet of wood is transported away for pressing, and is in the process of leaving the system 1. The transport means 3 are moving in the direction of the processing station 4, and, in doing so, pull the packet 2 of wood that has been aligned flush at its face end. At the same time, the packet 8 of wood is both pushed upstream and aligned by means of the pusher 6.

Figure 5:
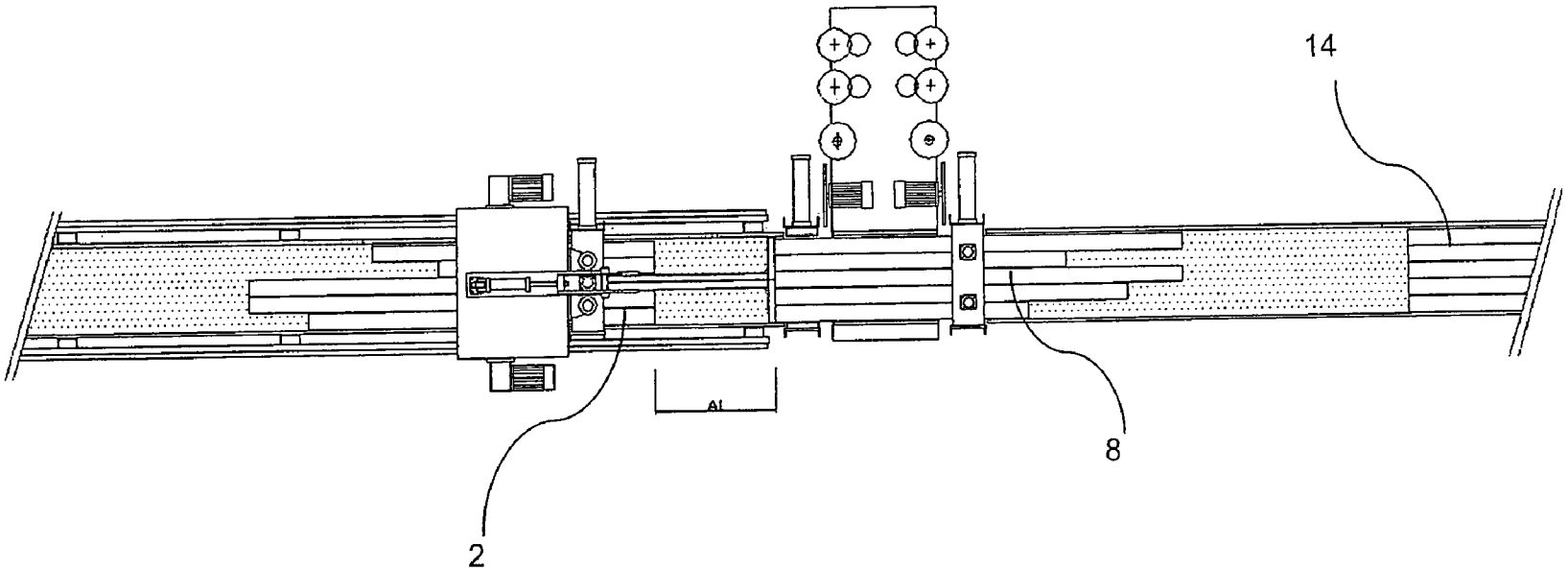
FIG. 5 a top view of the device from FIG. 1, before processing of a packet of wood.

FIG. 5 shows a top view of the device from FIG. 1, before processing of a packet of wood. It shows how the packet 8 of wood is transported through the processing station 4 by the pusher 6.

Figure 6:
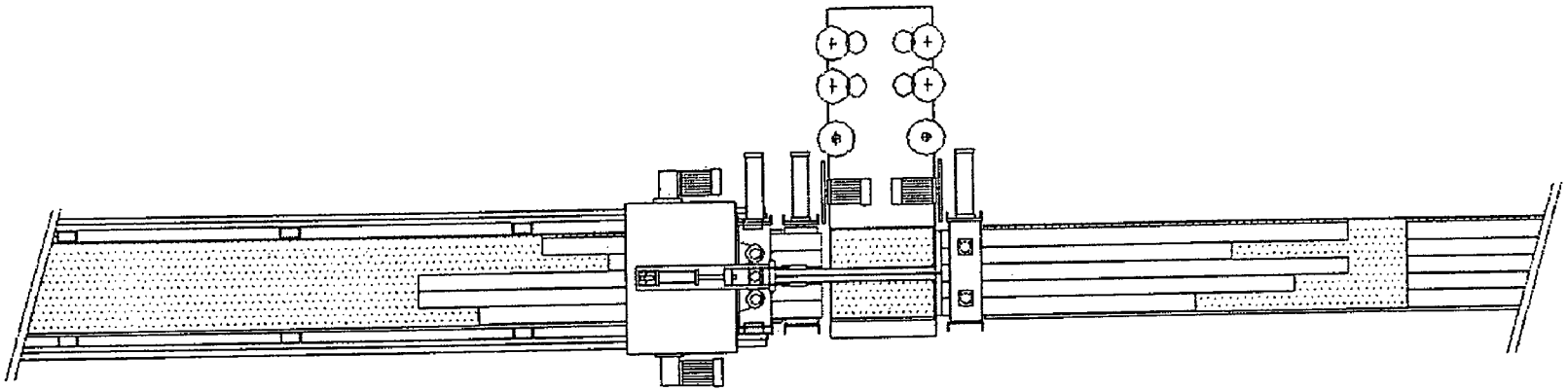
FIG. 6 a top view of the device from FIG. 1, with the transport means in their end position.

FIG. 6 shows a top view of the device from FIG. 1, with the transport means 3 in their end position. In this connection, both the gripping device 50 and the pusher 6 have reached their maximal position in the direction of the processing station 4. Both packets of wood are clamped by means of the front 10 and rear clamping device 11, and can then be processed in their fixed position.

Figure 7:
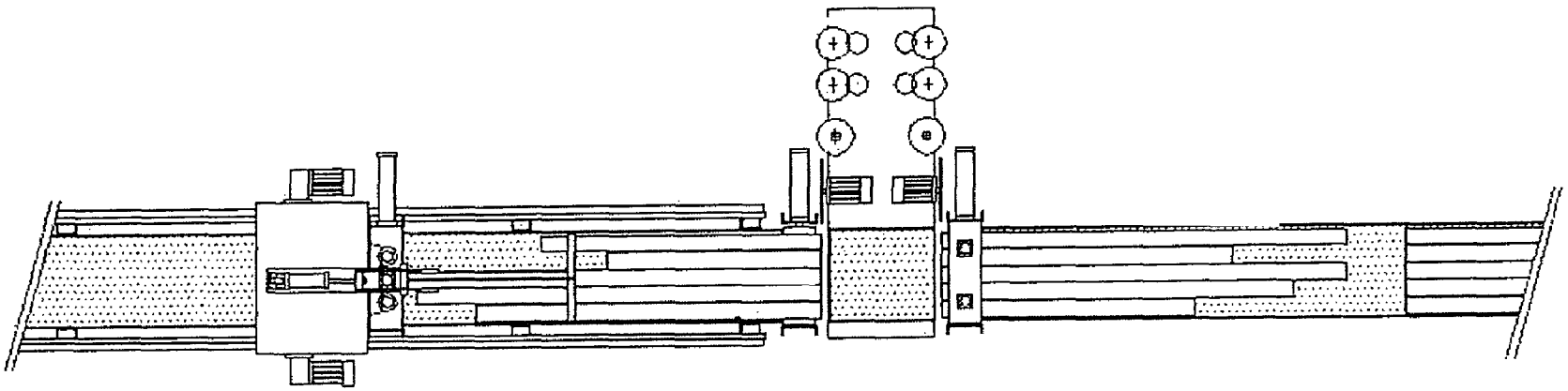
FIG. 7 a top view of the device from FIG. 1, with the transport means during retraction to their starting position.

FIG. 7 shows a top view of the device from FIG. 1, with the transport means 3 during retraction to their starting position. During retraction, the pusher 6 is raised by means of a lifting device 23, so that it does not come into contact with the packet of wood having multiple pieces 2 of wood, and disturb its transport.

Figure 8:
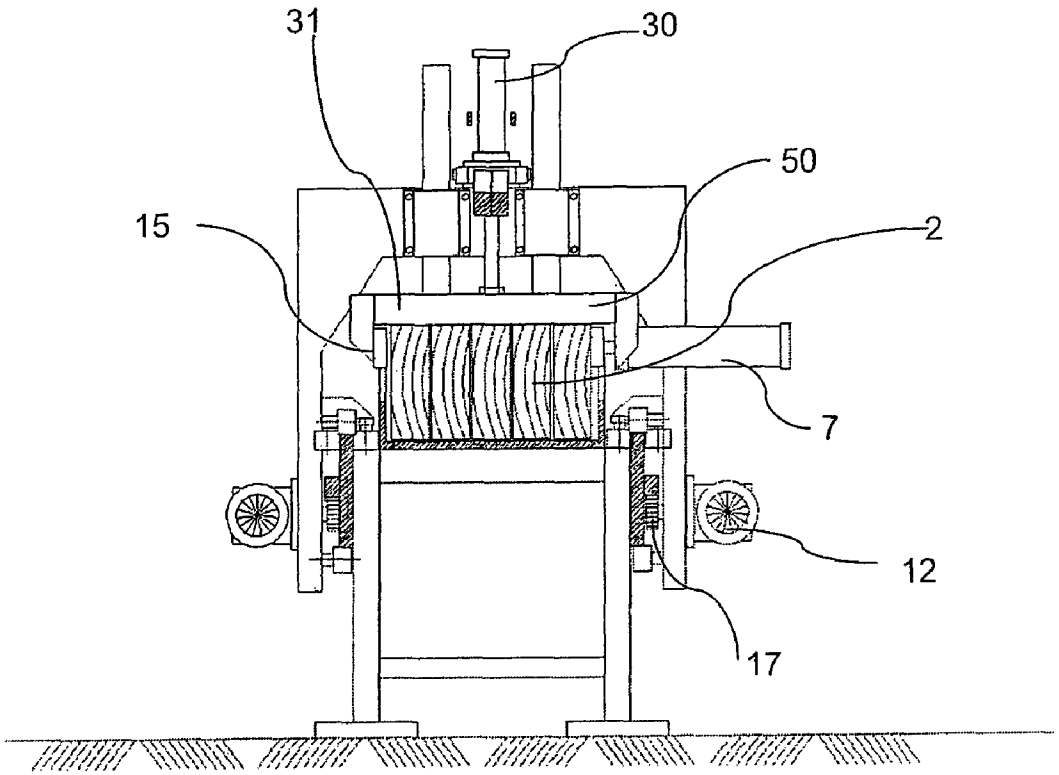
FIG. 8 a vertical section through the transport device.

FIG. 8 shows a vertical section through the transport means 3. The contact surfaces 15 are shown, by way of which pressure is exerted on the packet of wood having multiple pieces 2 of wood, by means of the pneumatic clamping cylinder 7, in order to hold the packet in place. Another clamping cylinder 30, disposed on the top, exerts additional pressure from above, so that the packet of wood having multiple pieces 2 of wood is grasped from three sides.

Figure 9:
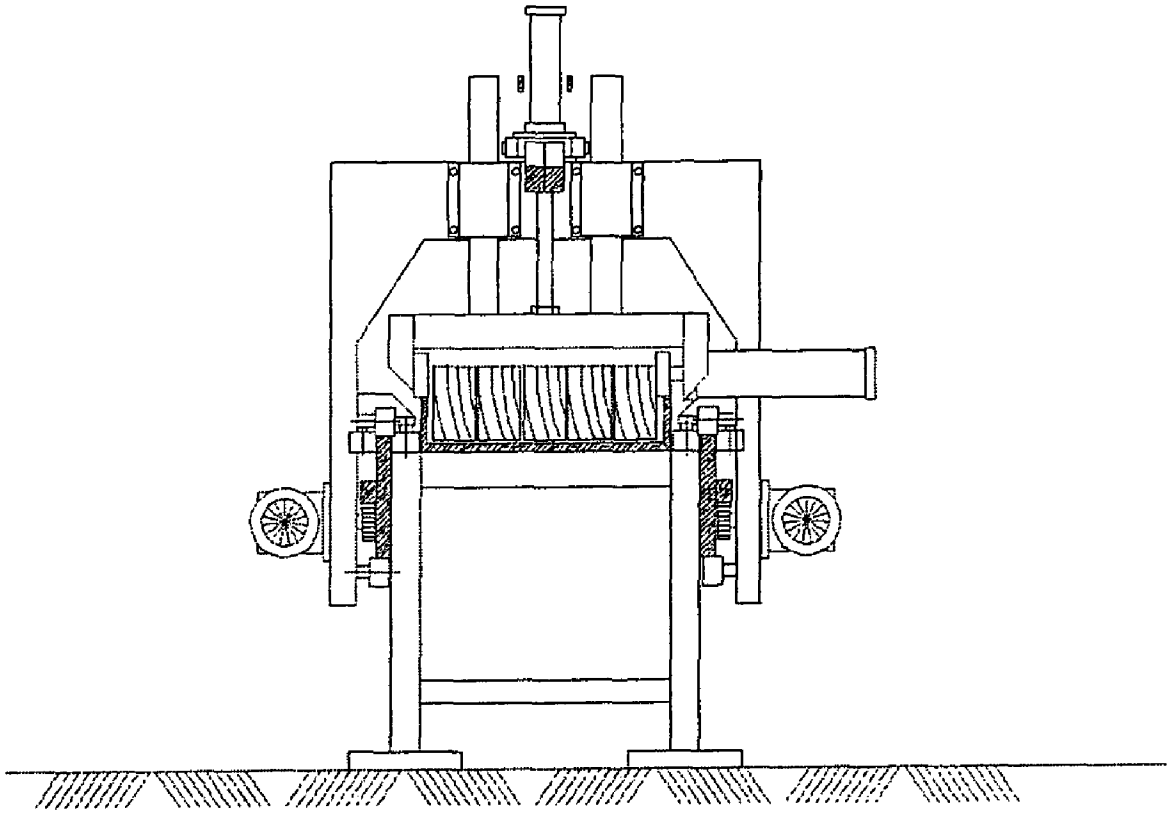
FIG. 9 a vertical section through the transport device as in FIG. 8, with a packet of wood having a lower height.

FIG. 9 shows a vertical section through the transport means 3 as in FIG. 8, with a packet of wood having a lower height. The representation shows how the system 1 can be adapted to pieces of wood having different heights.

Figure 10:
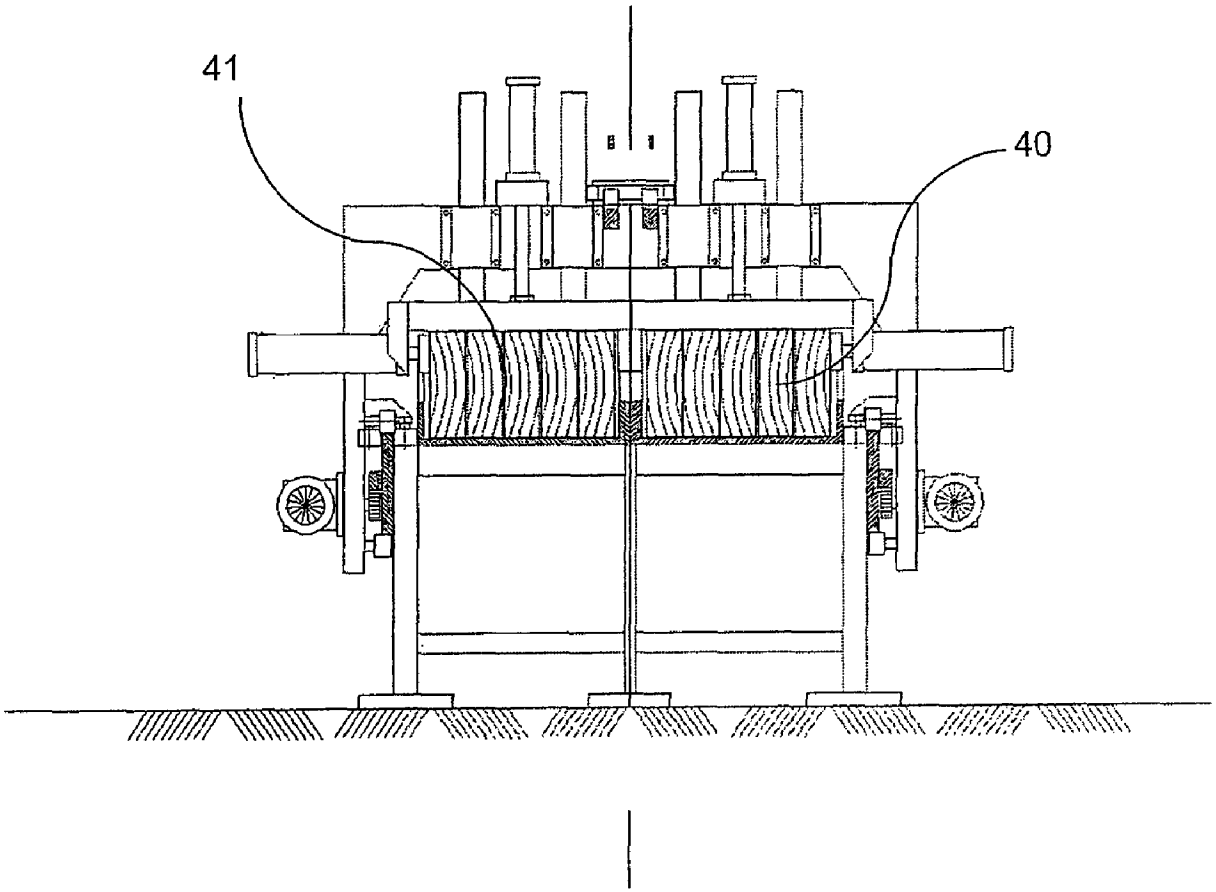
FIG. 10 a vertical section through another embodiment of the transport device, with two packets of wood.

FIG. 10 shows a vertical section through another embodiment of the transport means 3, with two gripper devices in which two packets of wood having multiple pieces 40, 41 of wood are clamped. The output of the system 1 is increased by means of the simultaneous transport of two packets of wood.

Figure 11:
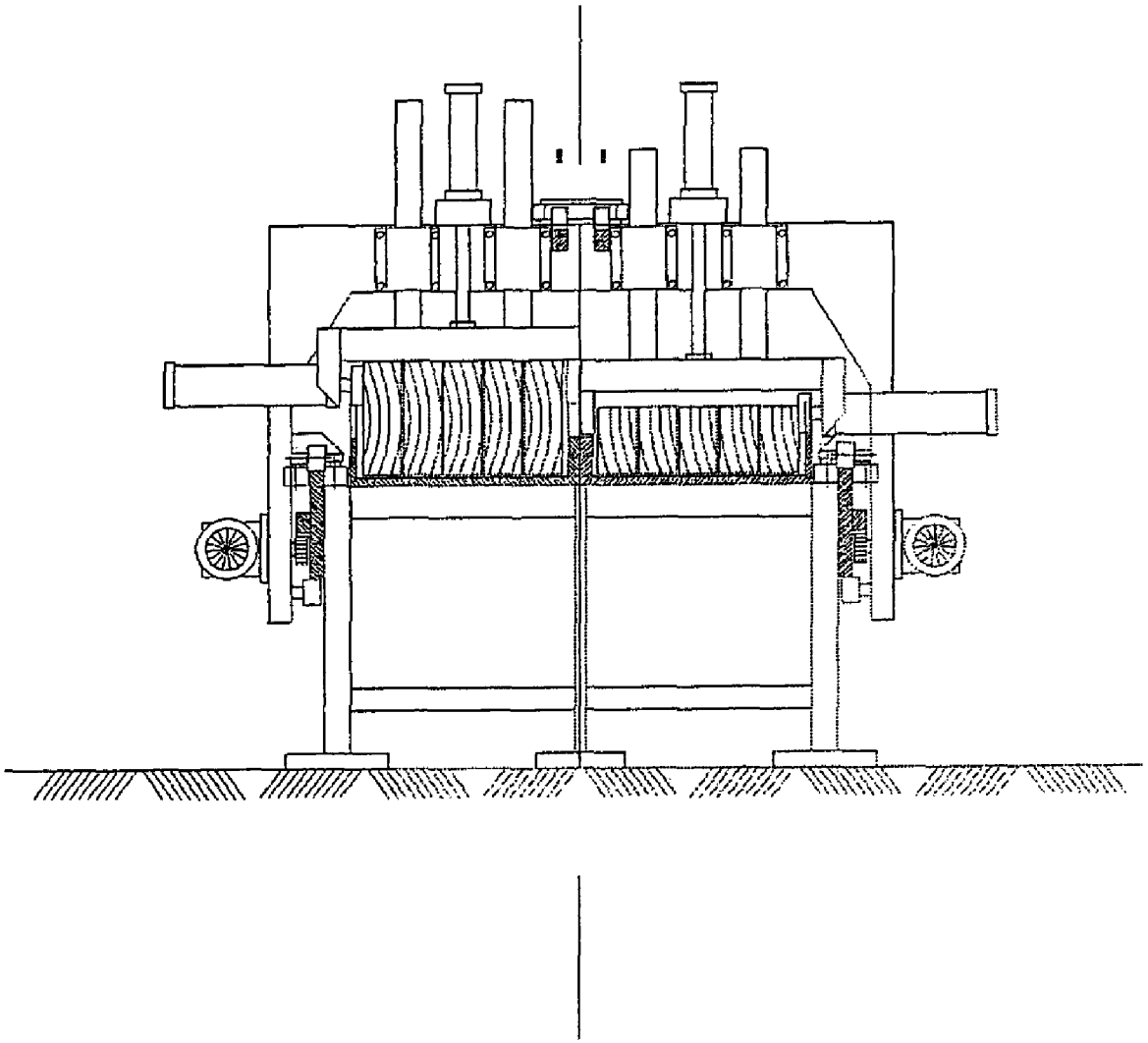
FIG. 11 a vertical section through the transport device from FIG. 10, with two packets of wood having different heights.

FIG. 11 shows a vertical section through the transport means 3 as in FIG. 10, with two packets of wood having different heights. The representation shows how the other embodiment of the system 1 can be adapted to pieces of wood having different heights. In this way, it is possible to process packets of wood having different heights, at the same time.

Figure 12:
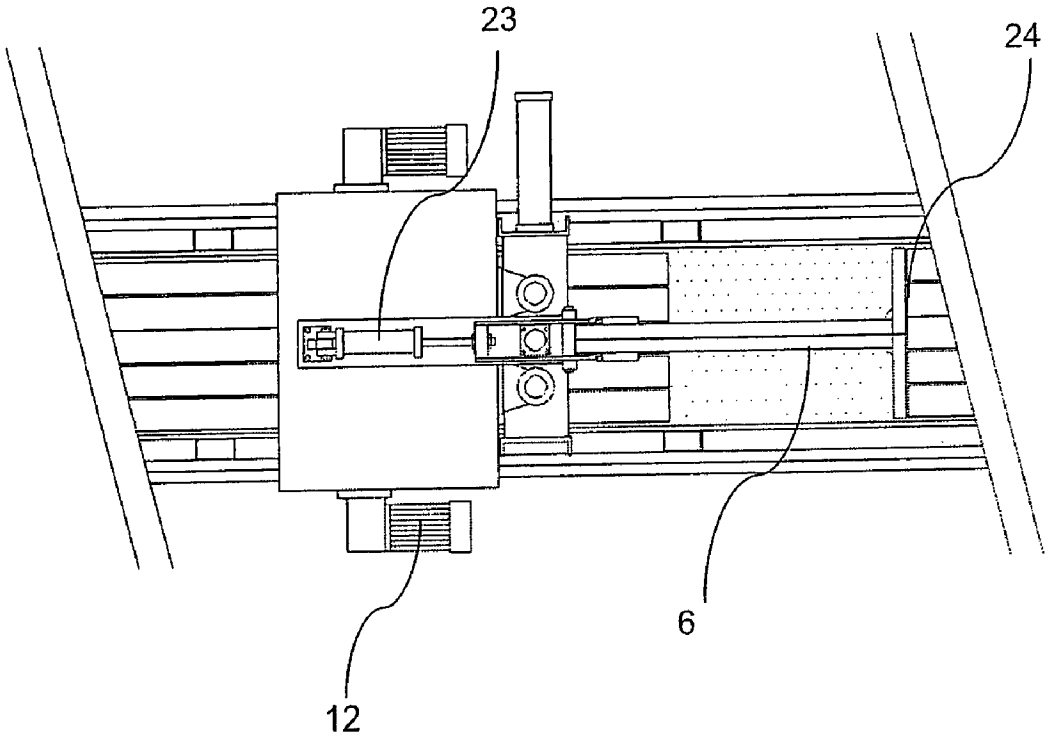
FIG. 12 a top view of the transport device with a pusher, in detail.

FIG. 12 shows a top view of the transport means 3, with a pusher 6, in detail.

Figure 13:
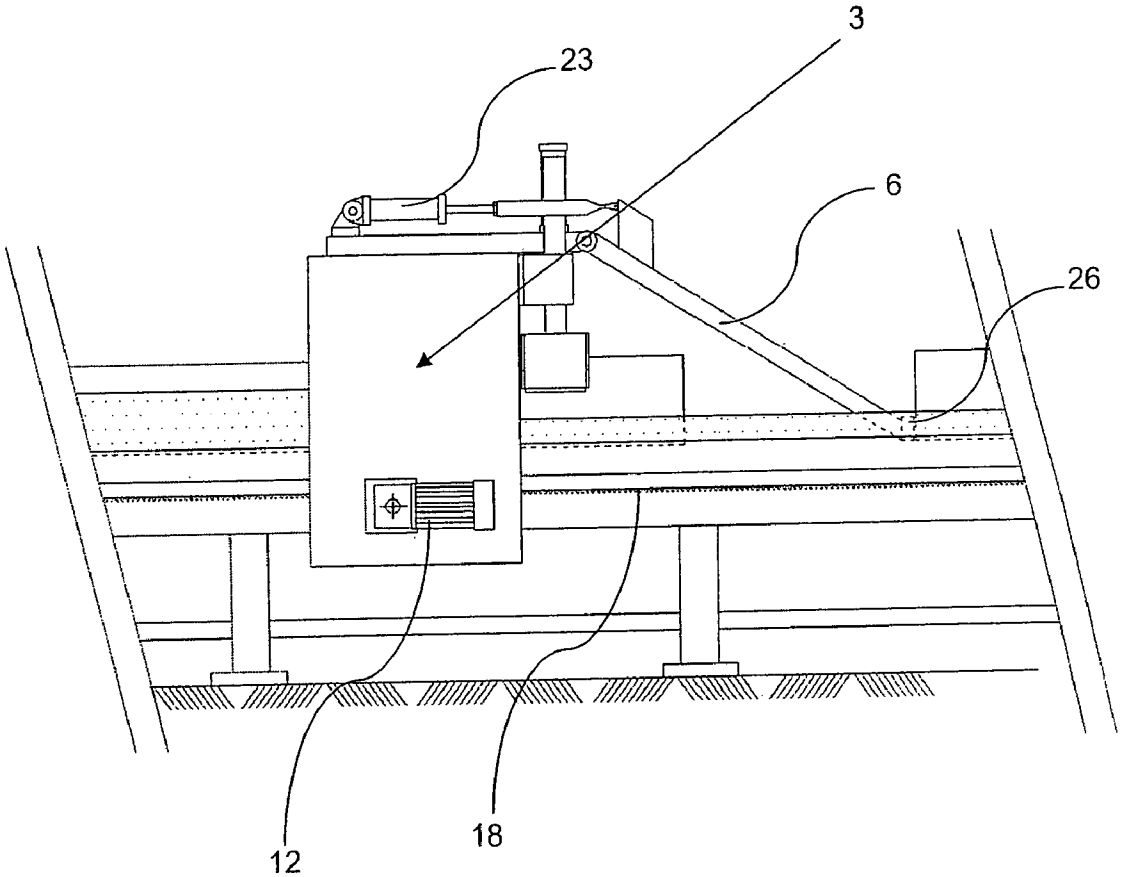
FIG. 13 the transport device with a pusher, in a side view.

FIG. 13 shows the transport device with pusher 6, in a side view. The transport means 3 can be moved in the horizontal transport direction. Electric motors 12 serve as a drive. The rotation of the motor shaft (not shown) is converted into a linear movement by way of a gear wheel 17 (not shown) and a rack 18. The pusher 6 can be raised or lowered by means of a lifting device 23. The pusher 6 is lowered for pushing and aligning, so that its contact surface 24 lies against the face sides of the pieces 2 of wood. If, in contrast, the pusher 6 is moved back into its starting position, counter to the transport direction, then it is raised so that it does not come into contact with the following packet of wood and disrupt its transport.

What is claimed is:

1. A transport device for a system (1) for finger jointing pieces of (2, 8, 14) of wood, by packets, having a support (9), wherein transport means (3) are provided, which are set up for moving the pieces (2, 8, 14) of wood sliding along the support (9) to the system (1) for finger jointing, and wherein the transport means (3) have a gripping device (50), for holding the pieces (2, 8, 14) of wood in place by packets, aligned flush at a first end which is situated upstream, while the pieces (2, 8, 14) are being pulled to a work station (4) by way of the support (9).

2. The transport device according to claim 1, wherein the gripping device (50) is set up for grasping and clamping the pieces (2) of wood on a respective longitudinal side and at a respective top, by means of a clamping device (5).

3. The transport device according to claim 2, wherein the gripping device (50) has at least one clamping device (5) having a clamping cylinder (7).

4. The transport device according to claim 1, wherein the transport means (3) have a pusher (6) that is set up to align the pieces (8) of wood flush at a second end, and push the pieces (8) upstream.

5. A transport means (3) for a system (1) for finger jointing pieces (2, 8, 14) of wood, by packets, having a support (9), wherein transport means (3) are set up for moving the pieces (2, 8, 14) of wood sliding along the support (9) to the system (1) for finger jointing, and wherein the transport means (3) have a gripping device (50), for holding the pieces (2, 8, 14) of wood in place by packets, aligned flush at a first end which is situated upstream, while the pieces (2, 8, 14) are being pulled to a work station (4) by way of the support (9).

6. A method for transporting pieces (2, 8, 14) of wood for a system (1) for finger jointing, by packets, wherein the pieces (2, 8, 14) of wood are moved sliding along a support (9) to the system (1) for finger jointing by a transport means (3), wherein a gripping device (50) of the transport means (3) holds the pieces (2, 8, 14) of wood in place, by packets, and aligned flush at a first end which is situated upstream, while the pieces (2, 8, 14) are being pulled to a work station (4) by way of the support (9).

7. The method according to claim 6, wherein a pusher aligns the pieces (2, 8, 14) of wood flush at a second end, by packets, and pushes the pieces (2, 8, 14) upstream.

* * * * *